US005532121A

United States Patent [19]

Yonkoski et al.

[11] Patent Number: 5,532,121

[45] Date of Patent: *Jul. 2, 1996

[54] MOTTLE REDUCING AGENT FOR PHOTOTHERMOGRAPHIC AND THERMOGRAPHIC ELEMENTS

[75] Inventors: Roger K. Yonkoski, Woodbury; Patricia M. Savu, Maplewood, both of Minn.

[73] Assignee: Minnesota Mining and Manufacturing Company, St. Paul, Minn.

[ * ] Notice: The term of this patent shall not extend beyond the expiration date of Pat. No. 5,380,644.

[21] Appl. No.: 410,332

[22] Filed: Mar. 24, 1995

[51] Int. Cl.[6] ..... G03C 1/498

[52] U.S. Cl. ..... 430/617; 430/203; 430/223; 430/350; 430/619; 430/631

[58] Field of Search ..... 430/617, 619, 430/631, 634, 529, 350, 48, 203, 223

[56] References Cited

U.S. PATENT DOCUMENTS

| | | | |
|---|---|---|---|
| 3,457,075 | 7/1969 | Morgan et al. | 96/67 |
| 3,573,916 | 4/1971 | Yost et al. | 96/74 |
| 3,839,049 | 10/1974 | Simons | 96/114.6 |
| 3,846,136 | 11/1974 | Sullivan | 96/114.1 |
| 3,885,965 | 5/1975 | Hughes et al. | 96/48 HD |
| 3,950,298 | 4/1976 | McCown et al. | 260/33.6 F |
| 3,994,732 | 11/1976 | Winslow | 96/114.1 |
| 4,021,249 | 5/1977 | Noguchi et al. | 96/114.1 |
| 4,260,677 | 4/1981 | Winslow et al. | 430/618 |
| 4,365,423 | 12/1982 | Arter et al. | 34/23 |
| 4,367,283 | 1/1983 | Nakayama et al. | 430/631 |
| 4,557,837 | 12/1985 | Clark, III et al. | 252/8.55 C |
| 4,764,450 | 8/1988 | Ruckert et al. | 430/191 |
| 4,853,314 | 8/1989 | Ruckert et al. | 430/191 |
| 4,894,927 | 1/1990 | Ogawa et al. | 34/32 |
| 4,963,476 | 10/1990 | Sugimoto et al. | 430/631 |
| 4,999,927 | 3/1991 | Durst et al. | 34/23 |
| 5,028,523 | 7/1991 | Skong | 430/617 |
| 5,061,769 | 10/1991 | Aharoni | 526/245 |
| 5,270,378 | 12/1993 | Johnson et al. | 524/520 |
| 5,380,644 | 1/1995 | Yonkoski et al. | 430/619 |

FOREIGN PATENT DOCUMENTS 0182516 10/1985 European Pat. Off. .

OTHER PUBLICATIONS

*Research Disclosure,* Jun. 1978, Item No. 17029.

*Unconventional Imaging Processes;* E. Brinkman et al.; The Focal Press; Lond & New York: 1978, pp. 74–75.

*Primary Examiner*—Thorl Chea

*Attorney, Agent, or Firm*—Gary L. Griswold; Walter N. Kirn; Gregory A. Evearitt

[57] ABSTRACT

Reduction of mottle and other surface anomalies in photothermographic and thermographic elements is reduced by the incorporation of a fluorinated polymer containing at least two different groups within the polymer chain derived from reactive monomers, the groups being: a fluorinated, ethylenically unsaturated monomer; and a polar, ethylenically unsaturated monomer.

21 Claims, No Drawings

MOTTLE REDUCING AGENT FOR PHOTOTHERMOGRAPHIC AND THERMOGRAPHIC ELEMENTS

BACKGROUND OF THE INVENTION

1. Field of the Invention

The present invention relates to novel fluorochemical surfactants and in particular, it relates to the use of novel fluorochemical surfactants in photothermographic and thermographic elements. The use of fluorochemical surfactants in coating compositions reduces disuniformities such as mottle in photothermographic and thermographic coatings.

2. Background of the Art

Silver halide-containing, photothermographic imaging materials (i.e., heat-developable photographic elements) processed with heat, and without liquid development, have been known in the art for many years. These materials are also known as "dry silver" compositions or emulsions and generally comprise a support having coated thereon: (a) a photosensitive compound that generates silver atoms when irradiated; (b) a non-photosensitive, reducible silver source; (c) a reducing agent (i.e., a developer) for silver ion, for example the silver ion in the non-photosensitive, reducible silver source; and (d) a binder.

The photosensitive compound is generally photographic silver halide which must be in catalytic proximity to the non-photosensitive, reducible silver source. Catalytic proximity requires an intimate physical association of these two materials so that when silver atoms (also known as silver specks, clusters, or nuclei) are generated by irradiation or light exposure of the photographic silver halide, those nuclei are able to catalyze the reduction of the reducible silver source. It has long been understood that silver atoms ($Ag^{\circ}$) are a catalyst for the reduction of silver ions, and that the photosensitive silver halide can be placed into catalytic proximity with the non-photosensitive, reducible silver source in a number of different fashions. The silver halide may be made "in situ" for example, by adding a halogen-containing source to the reducible silver source to achieve partial metathesis (see, for example, U.S. Pat. No. 3,457,075); or by coprecipitation of silver halide and the reducible silver source material (see, for example, U.S. Pat. No. 3,839,049). The silver halide may also be made "ex situ" and added to the organic silver salt. The addition of silver halide grains to photothermographic materials is described in Research Disclosure, June 1978, Item No. 17029. It is also reported in the art that when silver halide is made ex situ, one has the possibility of controlling the composition and size of the grains much more precisely so that one can impart more specific properties to the photothermographic element and can do so much more consistently than with the in situ technique.

The non-photosensitive, reducible silver source is a material that contains silver ions. Typically, the preferred non-photosensitive reducible silver source is a silver salt of a long chain aliphatic carboxylic acid having from 10 to 30 carbon atoms. The silver salt of behenic acid or mixtures of acids of similar molecular weight are generally used. Salts of other organic acids or other organic materials, such as silver imidazolates, have been proposed. U.S. Pat. No. 4,260,677 discloses the use of complexes of inorganic or organic silver salts as non-photosensitive, reducible silver sources.

In both photographic and photothermographic emulsions, exposure of the photographic silver halide to light produces small clusters of silver atoms ($Ag^{\circ}$). The imagewise distribution of these clusters is known in the art as a latent image. This latent image is generally not visible by ordinary means. Thus, the photosensitive emulsion must be further processed to produce a visible image. This is accomplished by the reduction of silver ions which are in catalytic proximity to silver halide grains bearing the clusters of silver atoms, (i.e., the latent image). This produces a black and white image. In photographic elements, the silver halide is reduced to form the black-and-white image. In photothermographic elements, the light-insensitive silver source is reduced to form the visible black-and-white image while much of the silver halide remains as silver halide and is not reduced.

In photothermographic and thermographic elements the reducing agent for the organic silver salt, often referred to as a "developer", may be any material, preferably any organic material, that can reduce silver ion to metallic silver. At elevated temperatures, in the presence of the latent image, the non-photosensitive reducible silver source (e.g., silver behenate) is reduced by the reducing agent for silver ion. This produces a negative black-and-white image of elemental silver.

While conventional photographic developers such as methyl gallate, hydroquinone, substituted-hydroquinones, catechol, pyrogallol, ascorbic acid, and ascorbic acid derivatives are useful, they tend to result in very reactive photothermographic formulations and fog during preparation and coating of photothermographic elements. As a result, hindered phenol reducing agents have traditionally been preferred.

As the visible image in black-and-white photothermographic and thermographic elements is usually produced entirely by elemental silver ($Ag^{\circ}$), one cannot readily decrease the amount of silver in the emulsion without reducing the maximum image density. However, reduction of the amount of silver is often desirable to reduce the cost of raw materials used in the emulsion and/or to enhance performance. For example, toning agents may be incorporated to improve the color of the silver image of the photothermographic elements as described in U.S. Pat. Nos. 3,846,136; 3,994,732; and 4,021,249.

Another method of increasing the maximum image density in photographic and photothermographic emulsions without increasing the amount of silver in the emulsion layer is by incorporating dye-forming or dye-releasing materials in the emulsion. Upon imaging, the dye-forming or dye-releasing material is oxidized, and a dye and a reduced silver image are simultaneously formed in the exposed region. In this way, a dye-enhanced black-and-white silver image can be produced.

Thermographic imaging constructions (i.e., heat-developable materials) processed with heat, and without liquid development, are widely known in the imaging arts and rely on the use of heat to help produce an image. These elements generally comprise a support or substrate (such as paper, plastics, metals, glass, and the like) having coated thereon: (a) a thermally-sensitive, reducible silver source; (b) a reducing agent for the thermally-sensitive, reducible silver source (i.e., a developer); and (c) a binder.

In a typical thermographic construction, the image-forming layers are based on silver salts of long chain fatty acids. Typically, the preferred non-photosensitive reducible silver source is a silver salt of a long chain aliphatic carboxylic acid having from 10 to 30 carbon atoms. The silver salt of behenic acid or mixtures of acids of similar molecular weight are generally used. At elevated temperatures, silver behenate is reduced by a reducing agent for silver ion such as methyl gallate, hydroquinone, substituted-hydroquinones, hindered phenols, catechol, pyrogallol, ascorbic acid, ascorbic acid derivatives, and the like, whereby an image comprised of elemental silver is formed.

Many times, the thermographic construction is brought into contact with the thermal head of a thermographic recording apparatus, such as a thermal printer, thermal facsimile, and the like. In such instances, an anti-stick layer is coated on top of the imaging layer to prevent sticking of the thermographic construction to the thermal head of the apparatus utilized. The resulting thermographic construction is then heated to an elevated temperature, typically in the range of about 60°–225° C., resulting in the formation of an image.

The imaging arts have long recognized that the fields of photothermography and thermography are clearly distinct from that of photography. Photothermographic and thermographic elements differ significantly from conventional silver halide photographic elements which require wet-processing In photothermographic and thermographic imaging elements a visible image is created by heat as a result of the reaction of a developer incorporated within the element. Heat is essential for development and temperatures of over 100° C. are routinely required. In contrast, conventional wet-processed photographic imaging elements require processing in aqueous processing baths to provide a visible image (e.g., developing and fixing baths) and development is usually performed at a more moderate temperature (e.g., 30°–50° C.).

In photothermographic elements only a small amount of silver halide is used to capture light and a different form of silver (e.g., silver behenate) is used to generate the image with heat. Thus, the silver halide serves as a catalyst for the development of the non-photosensitive, reducible silver source. In contrast, conventional wet-processed black-and-white photographic elements use only one form of silver (e.g., silver halide) which, upon development, is itself converted to the silver image. Additionally, photothermographic elements require an amount of silver halide per unit area that is as little as one-hundredth of that used in conventional wet-processed silver halide.

Photothermographic systems employ a light-insensitive silver salt, such as silver behenate, which participates with the developer in developing the latent image. In contrast, photographic systems do not employ a light-insensitive silver salt directly in the image-forming process. As a result, the image in photothermographic elements is produced primarily by reduction of the light-insensitive silver source (silver behenate) while the image in photographic black-and-white elements is produced primarily by the silver halide.

In photothermographic and thermographic elements all of the "chemistry" of the system is incorporated within the element itself. For example, photothermographic and thermographic elements incorporate a developer (i.e., a reducing agent for the non-photosensitive reducible source of silver) within the element while conventional photographic elements do not. The incorporation of the developer into photothermographic elements can lead to increased formation of "fog" upon coating of photothermographic emulsions as compared to photographic emulsions. Even in so-called instant photography, developer chemistry is physically separated from the silver halide until development is desired. Much effort has gone into the preparation and manufacture of photothermographic and thermographic elements to minimize formation of fog upon coating, storage, and post-processing aging.

Similarly, in photothermographic elements, the unexposed silver halide inherently remains after development and the element must be stabilized against further development. In contrast, the silver halide is removed from photographic elements after development to prevent further imaging (i.e., the fixing step).

In photothermographic and thermographic elements the binder is capable of wide variation and a number of binders are useful in preparing these elements. In contrast, photographic elements are limited almost exclusively to hydrophilic colloidal binders such as gelatin.

Because photothermographic and thermographic elements require thermal processing, they pose different considerations and present distinctly different problems in manufacture and use. In addition, the effects of additives (e.g., stabilizers, antifoggants, speed enhancers, sensitizers, supersensitizers, etc.) which are intended to have a direct effect upon the imaging process can vary depending upon whether they have been incorporated in a photothermographic or thermographic element or incorporated in a photographic element.

Distinctions between photothermographic and photographic elements are described in *Imaging Processes and Materials* (Neblette's Eighth Edition); J. Sturge et al. Ed; Van Nostrand Reinhold: New York, 1989; Chapter 9 and in *Unconventional Imaging Processes;* E. Brinckman et al, Ed; The Focal Press: London and New York: 1978; pp. 74–75.

Photothermographic and thermographic constructions are usually prepared by coating from solution and removing most of the coating solvent by drying. One common problem that exists with coating photothermographic systems is the formation of coating defects. Many of the defects and problems that occur in the final product can be attributable to phenomena that occur in the coating and drying procedures. Among the problems that are known to occur during drying of polymeric film layers after coating are unevenness in the distribution of solid materials within the layer. Examples of specific types of coating defects encountered are "orange peel", "mottling", and "fisheyes". Orange peel is a fairly regular grainy surface that occurs on a dried coated film, usually because of the action of the solvent on the materials in the coating composition. Mottling often occurs because of an unevenness in the removal of the solvent from the coating composition. "Fisheyes" are another type of coating problem, usually resulting from a separation of components during drying. There are pockets of different ingredients within the drying solution, and these pockets dry out into uneven coating anomalies.

Surfactants have often been used to correct these types of problems, along with changes in the solvents of the coating compositions. In some cases, surfactants do not correct the problem, and in other cases the surfactants create other problems even when they cure the first problem. It is sometimes necessary to investigate a large number of commercially available surfactants before finding one that is appropriate for a particular type of system, even if that commercial product is touted for use in correcting a particular type of defect.

For a surfactant to be useful in an imaging element is must have several properties. It must be soluble in the coating solution or emulsion. If it were not, then other defects such as "fisheyes" and streaks may occur in the dried coating. The surfactant must not stabilize foams or air bubbles with the coating solution or emulsion as these cause streaks in the dried coating. These defects are readily visible and are unacceptable in a final element. Additionally, the surfactant cannot significantly alter the sensitometric properties of the imaging element such as speed, contrast, minimum density, and maximum density.

Fluorochemical surfactants are useful in coating applications to reduce mottle. When a coating solution is dried at high speeds in an industrial oven, the resulting film often contains a mottle pattern. This mottle pattern is often the result of surface tension gradients created by non-uniform drying conditions. When an appropriate fluorochemical surfactant is added to the coating solution, the surfactant holds the surface tension at a lower but constant value. This results in a uniform film, free from mottle. Fluorochemical surfactants are used because organic solvents such as 2-butanone (also known as methyl ethyl ketone or MEK) already have such low surface energies (24.9 dyne/cm) that hydrocarbon surfactants are ineffective.

U.S. Pat. Nos. 4,764,450 and 4,853,3 14 describe the use of particular changes in solvent systems to improve surface defects in positive-acting photoresist imaging systems.

U.S. Pat. No. 4,557,837 describes fluorochemicals useful in the preparation of foamable compositions such as those used in the cleanup of gas wells. Polymers described include copolymers of fluorochemical monomers and hydroxyethylacrylate, and copolymers of fluorochemical monomers, acrylic acid, and short chain acrylates.

JP 01-223,168 describes fluorinated terpolymers that are useful additives to varnish formulations. They improve the stain resistance of the varnish.

JP 57-040579 describes fluorinated terpolymers which are useful as release coatings for adhesive tapes.

U.S. Pat. No. 3,885,965 describes the use of poly(dimethylsiloxane) to resist "orange peel" effects in photothermographic elements.

U.S. Pat. No. 3,950,298 describes thermoplastic fluorinated terpolymers that are useful as non-foaming additives to coating solutions for polymeric materials such as carpets and fibers. The coating compositions provide oleophobicity to the surfaces that are coated.

U.S. Pat. No. 4,365,423 describes a process where a foraminous shield (such as a screen or perforated plate) is used to protect the coated web from the impingement air used for dying. Both solvent-rich and solvent-poor air can flow through the shield. Air velocity and turbulence are reduced by the porous shield. Although this method is claimed to reduce the degree of mottle, the amount and presence of mottle was still influenced by increased flow rate of the impingement air.

U.S. Pat. No. 4,999,927 describes an oven system for which the air flow boundary layer along the web remains laminar. This is accomplished by accelerating the air through the drying chamber.

U.S. Pat. No. 4,894,927 describes a technique for reducing mottle by combining an inert gas system with a small drying chamber. Using this method, the air flow remains laminar over the web.

U.S. Pat. No. 3,573,916 describes the use of sulfo-substituted cyanine dyes to reduce mottle in color-bearing silver halide emulsions which have been coated on electron bombarded hydrophobic surfaces.

U.S. Pat. No. 5,270,378 describes the use of fluorochemical surfactants to reduce coating disuniformities such as mottle, fisheye, and foaming in positive-acting or negative-acting resist systems such as printing plates and other non-resist imageable polymerizable systems. These polymers are comprise a fluorochemical acrylate, a short-chain-alkyl acrylate, and a polar monomer. Use of these materials in photothermographic or thermographic elements is not discussed.

U.S. Pat. No. 5,380,644 describes the use of fluorinated terpolymers having at least three different groups within the polymer chain. The groups are derived from a) a fluorinated, ethylenically unsaturated monomer, b) a hydroxyl-containing ethylenically unsaturated monomer, and c)a polar, ethylenically unsaturated monomer. The fluorinated terpolymers formed by the polymerization of the above mentioned monomers provide a surfactant that is particularly useful in the coating of photothermographic and thermographic elements. The surfactants can reduce surface anomalies such as mottle when used with certain solvent systems.

SUMMARY OF THE INVENTION

The present invention provides photothermographic elements coated on a support wherein the photothermographic element comprises:

(a) a photosensitive silver halide;

(b) a non-photosensitive, reducible source of silver;

(c) a reducing agent for the non-photosensitive, reducible source of silver;

(d) a binder; and (e) a fluorinated polymer consisting essentially of two different groups within the polymer chain derived from reactive monomers, the groups consisting essentially of:

(i) at least one fluorinated, ethylenically unsaturated monomer; and (ii) at least one polar, ethylenically unsaturated monomer.

When the photothermographic element used in this invention is heat developed, preferably at a temperature of from about 80° C. to about 250° C. (176° F. to 482° F.) for a duration of from about 1 second to about 2 minutes, in a substantially water-free condition after, or simultaneously with, imagewise exposure, a black-and-white silver image is obtained.

The present invention also provides a process for the formation of a visible image by first exposing to electromagnetic radiation and thereafter heating the inventive photothermographic element described earlier herein.

The present invention also provides a process comprising the steps of:

(a) exposing the inventive photothermographic element described earlier herein to electromagnetic radiation, to which the silver halide grains of the element are sensitive, to generate a latent image;

(b) heating the exposed element to develop the latent image into a visible image;

(c) positioning the element with a visible image thereon between a source of ultraviolet or short wavelength visible radiation energy and an ultraviolet or short wavelength radiation photosensitive imageable medium; and (d) thereafter exposing the imageable medium to ultraviolet or short wavelength visible radiation through the visible image on the element, thereby absorbing ultraviolet or short wavelength visible radiation in the areas of the element where there is a visible image and transmitting ultraviolet or short wavelength visible radiation through areas of the element where there is no visible image.

The photothermographic element may be exposed in step (a) with visible, infrared, or laser radiation.

In photothermographic elements of the present invention, the layer(s) that contain the photographic silver salt are referred to herein as emulsion layer(s). According to the present invention, one or more components of the reducing agent system is added either to the emulsion layer(s) or to a layer or layers adjacent to the emulsion layer(s). Layers that are adjacent to the emulsion layer(s) may be, for example, protective topcoat layers, primer layers, interlayers, opacifying layers, antihalation layers, barrier layers, auxiliary layers, etc. It is preferred that the reducing agent system be present in the photothermographic emulsion layer or topcoat layer.

The photothermographic elements of this invention may be used to prepare black-and-white monochrome, or color images. The photothermographic material of this invention can be used, for example, in conventional black-and-white or color photothermography, in electronically generated black-and-white or color hardcopy recording, in the graphic arts area (e.g., phototypesetting), in digital proofing, and in digital radiographic imaging. The material of this invention provides high photospeeds, strongly absorbing black-and-white or color images, and a dry and rapid process.

In another embodiment, the present invention provides thermographic elements comprising a substrate coated with a thermographic composition comprising:

(a) a non-photosensitive, reducible source of silver;

(b) a reducing agent for the non-photosensitive, reducible source of silver;

(c) a binder; and (d) a fluorinated polymer consisting essentially of at least two different groups within the polymer chain derived from reactive monomers, the groups consisting essentially of:

(i) at least one fluorinated, ethylenically unsaturated monomer; and (ii) at least one polar, ethylenically unsaturated monomer.

In thermographic elements of the present invention, the layer(s) that contain the non-photosensitive reducible silver source are referred to herein as thermographic layer(s) or thermographic emulsion layer(s). When used in thermographic elements according to the present invention, one or more components of the reducing agent system is added either to the thermographic emulsion layer(s) or to a layer or layers adjacent to the emulsion layer(s). Layers that are adjacent to the emulsion layer(s) may be, for example, protective topcoat layers, primer layers, interlayers, opacifying layers, barrier layers, auxiliary layers, etc. It is preferred that the reducing agent system be present in the thermographic layer or topcoat layer.

The present invention also provides a process for the formation of a visible image by heating the inventive thermographic element described earlier herein.

The present invention also provides a process comprising the steps of:

(a) heating the inventive thermographic element described earlier herein to generate an image;

(b) positioning the element with a visible image thereon between a source of ultraviolet or short wavelength visible radiation energy and an ultraviolet or short wavelength radiation photosensitive imageable medium; and (c) thereafter exposing the imageable medium to ultraviolet or short wavelength visible radiation through the visible image on the element, thereby absorbing ultraviolet or short wavelength visible radiation in the areas of the element where there is a visible image and transmitting ultraviolet or short wavelength visible radiation through areas of the element where there is no visible image.

The thermographic element may be exposed in step (a) with visible, infrared, or laser radiation.

The thermographic elements of this invention may be used to prepare black-and-white, monochrome, or color images. The thermographic material of this invention can be used, for example, in conventional black-and-white or color thermography, in electronically generated black-and-white hardcopy recording, in the graphic arts area, and in digital proofing. The material of this invention provides high reactivity, provides strongly absorbing black-and-white or color images, and provides a dry and rapid process.

When the thermographic element used in this invention is heat developed, preferably at a temperature of from about 80° C. to about 250° C. (176° F. to 482° F.) for a duration of from about 1 second to about 2 minutes in a substantially water-free condition, a black-and-white silver image is obtained.

The reducing agent for the non-photosensitive reducible silver source may optionally comprise a compound capable of being oxidized to form or release a dye. Preferably the dye-forming material is a leuco dye.

The polymers of this invention are effective at reducing or eliminating coating defects such as mottle when photothermographic and thermographic emulsions are coated from polar organic solvents such as ketones or alcohols. These compounds are added in minute quantities without significantly or adversely affecting the imaging or sensitometric properties of the photothermographic material.

Heating in a substantially water-free condition as used herein, means heating at a temperature of 80° to 250° C. The term "substantially water-free condition" means that the reaction system is approximately in equilibrium with water in the air, and water for inducing or promoting the reaction is not particularly or positively supplied from the exterior to the element. Such a condition is described in T. H. James, *The Theory of the Photographic Process,* Fourth Edition, Macmillan 1977, page 374.

As used herein:

"photothermographic element" means a construction comprising at least one photothermographic emulsion layer and any supports, topcoat layers, image receiving layers, blocking layers, antihalation layers, subbing or priming layers, etc.;

"thermographic element" means a construction comprising at least one thermographic emulsion layer and any support, topcoat layers, antihalation layers, blocking layers, etc.;

"emulsion layer" means a layer of a photothermographic or thermographic element that contains the non-photosensitive silver source material and the photosensitive silver halide (when used);

"ultraviolet region of the spectrum" means that region of the spectrum less than or equal to 400 nm, preferably from 100 nm to 400 nm. More preferably, the ultraviolet region of the spectrum is the region between 190 nm and 400 nm;

"short wavelength visible region of the spectrum" means that region of the spectrum from about 400 nm to about 450 nm;

"infrared region of the spectrum" means 750–1400 nm;

"visible region of the spectrum" means 400–750 nm; and

"red region of the spectrum" means 640–750 nm. Preferably the red region of the spectrum is 650–700 nm.

As is well understood in this area, substitution is not only tolerated, but is often advisable and substitution is anticipated on the compounds used in the present invention. As a means of simplifying the discussion and recitation of certain substituent groups, the terms "group" and "moiety" are used to differentiate between those chemical species that may be substituted and those which may not be so substituted. Thus, when the term "group," or "aryl group," is used to describe a substituent, that substituent includes the use of additional substituents beyond the literal definition of the basic group. Where the term "moiety" is used to describe a substituent, only the unsubstituted group is intended to be included. For example, the phrase, "alkyl group" is intended to include not only pure hydrocarbon alkyl chains, such as methyl, ethyl, propyl, t-butyl, cyclohexyl, iso-octyl, octadecyl and the like, but also alkyl chains beating substituents known in the art, such as hydroxyl, alkoxy, phenyl, halogen atoms (F, Cl, Br, and I), cyano, nitro, amino, carboxy, etc. For example, alkyl group includes ether groups (e.g., $CH_3$—$CH_2$—$CH_2$—O—$CH_2$—), haloalkyls, nitroalkyls, carboxyalkyls, hydroxyalkyls, sulfoalkyls, etc. On the other hand, the phrase "alkyl moiety" is limited to the inclusion of only pure hydrocarbon alkyl chains, such as methyl, ethyl, propyl, t-butyl, cyclohexyl, iso-octyl, octadecyl, and the like. Substituents that react with active ingredients, such as very strongly electrophilic or oxidizing substituents, would of course be excluded by the ordinarily skilled artisan as not being inert or harmless.

Other aspects, advantages, and benefits of the present invention are apparent from the detailed description, examples, and claims.

DETAILED DESCRIPTION OF THE INVENTION

The polymeric surfactants employed in the present invention are particularly useful in the manufacture of polymer coatings, most particularly in the manufacture of photothermographic and thermographic elements where surface anomalies (such as drying induced mottle) must be kept to a minimum. The fluorinated polymers are composed of at least two different groups and are derived from two different copolymerized monomers. The two monomers are: a fluorinated, ethylenically unsaturated monomer; and a polar, ethylenically unsaturated monomer.

The polymers can be conveniently prepared, thus generating a polymeric backbone with the required pendant functionalities thereon. This can be done conveniently by selecting appropriate ethylenically unsaturated monomers with the desired pendant functionalities already present on the monomers so that they are also deposited on the polymer backbone. This is preferably done by forming an acrylate backbone by polymerization of at least two materials. Although acrylates are not the only materials that will work, they are preferred for the backbone.

The polymers are prepared by free-radical polymerization of the two monomers in the proportions desired for the final product. The polymerization is carried out in solvents such as ethyl acetate, 2-butanone, ethanol, 2-propanol, acetone, etc.

Copolymers of this invention with a ratio of from about 90/10 wt. % to about 20/80 wt. % of fluorinated, ethylenically unsaturated monomer and polar ethylenically unsaturated monomer are useful in reducing mottle. Preferred copolymers of this invention are those having a ratio of from about 70/30 to about 35/65 wt. % of fluorinated, ethylenically unsaturated monomer and polar ethylenically unsaturated monomer. More preferred copolymers of this invention are those having a ratio of from about 35/65 wt. % to about 50/50 wt. % of fluorinated, ethylenically unsaturated monomer and polar ethylenically unsaturated monomer.

In its simplest form, the fluorochemical ethylenically unsaturated monomer contains a fluorocarbon group bonded to an ethylenically unsaturated group. Alternatively and preferably, the fluorocarbon group is bonded to a hydrocarbon portion which in turn is bonded to an ethylenically unsaturated group. The fluorochemical group may be directly bonded to the hydrocarbon group or it may be bonded through a bridging group such as a sulfonamido group. The preferred ethylenically unsaturated portion of the monomer is an acrylate group or a methacrylate group. The preferred bridging group is a sulfonamido group.

Representative fluorinated, ethylenically unsaturated monomers are as follows:

$C_8F_{17}CH_2CH_2N(CH_3)COCH{=}CH_2$
$C_8F_{17}CH_2CH_2OC\ OCH{=}CH_2$
$C_6F_{13}C_2H_{45}COCH{=}CH_2$,
$C_7F_{15}CH_2OCOC(CH_3){=}CH_2$
$C_8F_{17}SO_2N(C_2H_5)C_2H_4NHCOCH{=}CH_2$,
$(CF_3)_2CF(CF_2)_8C_2H_2SCOC(CH_3){=}CH_2$,
$C_8F_{17}SO_2N(CH_3)C_2H_4COOCH{=}CH_2$,
$C_8F_{17}SO_2N(CH_3CH_2C_6H_4CH{=}CH_2$,
$C_6F_{13}CH_2CH_2OOCC({=}CH_2)COOCH_2CH_2C_6F_{13}$,
$C_7F_{15}CH_2OOCCH{=}CHCOOCH_2C_7F_{15}$,
$C_6F_{13}C_2H_4N(CH_2CH_2OH)COCO{=}CH_2$,
$C_7F_{15}CON(C_2H_5)C_3H_6SCOC(CH_3){=}CH_2$,
$C_6F_{13}CH_2NHCOCO{=}CH_2$,
$C_8F_{17}CH_2CH_2OCH{=}CH_2$,
$(CF_3)_2CF(CF_2)_6CH_2CH(OH)CH_2OCOCH{=}CH_2$,
$(CH_3)_2CFOC_2F_4OCOCH{=}CH_2$,
$C_8F_{17}C_2H_4SO_2N(C_3H_7)C_2H_4OCOCH{=}CH_2$,
$C_7F_{15}C_2H_4CONHC_4H_8OCOCH{=}CH_2$ $$C_3F_7(\underset{\underset{CF_3}{|}}{CF}CF_2O)_2\underset{\underset{CF_3}{|}}{CF}CH_2OCOCH{=}CH_2,$$

$C_7F_{15}COOCH_2C(CH_3)_2CH_2OCOC(CH_3){=}CH_2$,
$C_8F_{17}SO_2N(C_2H_5)C_4H_8OCOCH{=}CH_2$,
$(C_3F_7)_2C_6H_3SO_2N(CH_3)C_2H_4OCOCH{=}CH_2$,
$C_8F_{17}CF{=}CHCH_2N(CH_3)C_2H_4OCOCH{=}CH_2$,

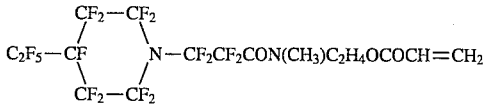

and combinations thereof. Preferred fluorinated, ethylenically unsaturated monomers are perfluoroaliphaticsulfonylamido acrylates and combinations thereof. Representative perfluoroaliphaticsulfonylamido acrylates include:

$C_8F_{17}SO_2N(C_2H_5)C_2H_4NHCOCH{=}CH_2$,
$C_8F_{17}SO_2N(CH_3)C_2H_4OCOCH{=}CH_2$,
$C_8F_{17}SO_2N(C_2H_5)C_2H_4OCOC(CH_3){=}CH_2$,
$C_8F_{17}SO_2N(CH_3)CH_2C_6H_4CH{=}CH_2$,
$C_8F_{17}C_2H_4SO_2N(C_3H_7)C_2H_4OCOCH{=}CH_2$,
$C_8F_{17}SO_2N(C_2H_5)C_4H_8OCOCH{=}CH_2$, and
$(C_3F_7)_2C_6H_3SO_2N(CH_3)C_2H_4OCOCH{=}CH_2$.

The polar ethylenically unsaturated monomer for use in the present invention must have a polymerizable group compatible with acrylic polymerization, i.e., have ethylenic unsaturation as would be the case in an acidic styrene derivative. Representative ethylenically unsaturated polar monomers useful in such preparation include:

N-vinylpyrrolidone,
$CH_2{=}CHP(O)(OH)_2$, $CH_2{=}CHCOOH$,
$CH_2{=}C(CH_3)COOH$,
$HOOCC({=}CH_2)CH_2COOH$,
$CH_2{=}CHSO_3H$,
$CH_2{=}CHCH_2SO_3H$,
$CH_2{=}CHCONHC(CH_3)_2CH_2SO_3H$,
and combinations thereof. Preferred polar monomers are acidic monomers of acrylates (including methacrylates).

Preferred copolymers of this invention have weight average molecular weights in the range of 2,000 to 20,000. Most preferred materials have weight average molecular weights of from 2,800 to 7,000.

The polymers useful in the present invention comprise any polymer soluble or dispersible in an organic solvent, such as 2-butanone, ethanol, and 90/10 mixtures of 2-butanone and ethanol.

In order to test the image uniformity of the film, it must be exposed to a uniform light intensity pattern and then uniformly heat processed. At this point the film can be inspected for spatial variation in the image density.

The fluorochemical surfactants of the present invention reduce coating defects in photothermographic elements without causing other deleterious side-effects in the coating or in the imaging properties of the photothermographic element.

According to the present invention, the fluorinated polymer is added either to one or more emulsion layers or to a layer or layers adjacent to one or more emulsion layers. Layers that are adjacent to emulsion layers may be for example, primer layers, image-receiving layers, interlayers, opacifying layers, antihalation layers, barrier layers, auxiliary layers, etc.

Photothermographic and thermographic articles of the present invention may contain other additives in combination with the fluorinated surfactant compounds of the invention, as well as other additives, such as shelf-life stabilizers, toners, development accelerators, and other image-modifying agents.

The amounts of the above-described ingredients that are added to the emulsion layer or top-coat layer according to the present invention may be varied depending upon the particular compound used and upon the type of emulsion layer (i.e., black-and-white or color). However, the amount of fluorinated polymer is preferably added to a top-coat layer in an amount of 0.05% to 10% and more preferably from 0.1% to 1% by weight of the layer.

The Photosensitive Silver Halide

As noted above, when used in a photothermographic element, the present invention includes a photosensitive silver halide. The photosensitive silver halide can be any photosensitive silver halide, such as silver bromide, silver iodide, silver chloride, silver bromoiodide, silver chlorobromoiodide, silver chlorobromide, etc. The photosensitive silver halide can be added to the emulsion layer in any fashion so long as it is placed in catalytic proximity to the organic silver compound which serves as a source of reducible silver.

The silver halide may be in any form which is photosensitive including, but not limited to cubic, octahedral, rhombic dodecahedral, orthorhombic, tetrahedral, other polyhedral habits, etc., and may have epitaxial growth of crystals thereon.

The silver halide grains may have a uniform ratio of halide throughout; they may have a graded halide content, with a continuously varying ratio of, for example, silver bromide and silver iodide; or they may be of the core-shell-type, having a discrete core of one halide ratio, and a discrete shell of another halide ratio. Core-shell silver halide grains useful in photothermographic elements and methods of preparing these materials are described in U.S. Pat. No. 5,382,504. A core-shell silver halide grain having an iridium doped core is particularly preferred. Iridium doped core-shell grains of this type are described in U.S. patent application Ser. No. 08/239,984 (filed May 9, 1994).

The silver halide may be prepared ex situ, (i.e., be pre-formed) and mixed with the organic silver salt in a binder prior to use to prepare a coating solution. The silver halide may be pre-formed by any means, e.g., in accordance with U.S. Pat. No. 3,839,049. For example, it is effective to blend the silver halide and organic silver salt using a homogenizer for a long period of time. Materials of this type are often referred to as "pre-formed emulsions." Methods of preparing these silver halide and organic silver salts and manners of blending them are described in Research Disclosure, June 1978, item 17029; U.S. Pat. Nos. 3,700,458 and 4,076,539; and Japanese patent application Nos. 13224/74, 17216/75, and 42529/76.

It is desirable in the practice of this invention to use pre-formed silver halide grains of less than 0.10 μm in an infrared sensitized, photothermographic material. Preferably the number average particle size of the grains is between 0.01 and 0.08 μm; more preferably, between 0.03 and 0.07 μm; and most preferably, between 0.04 and 0.06 μm. It is also preferred to use iridium doped silver halide grains and iridium doped core-shell silver halide grains as disclosed in U.S. patent application Ser. Nos. 08/072,153, and 08/239,984 described above.

Pre-formed silver halide emulsions when used in the material of this invention can be unwashed or washed to remove soluble salts. In the latter case, the soluble salts can be removed by chill-setting and leaching or the emulsion can be coagulation washed, e.g., by the procedures described in U.S. Pat. Nos. 2,618,556; 2,614,928; 2,565,418; 3,241,969; and 2,489,341.

It is also effective to use an in situ process, i.e., a process in which a halogen-containing compound is added to an organic silver salt to partially convert the silver of the organic silver salt to silver halide.

The light sensitive silver halide used in the present invention can be employed in a range of about 0.005 mole to about 0.5 mole; preferably, from about 0.01 mole to about 0.15 mole per mole; and more preferably, from 0.03 mole to 0.12 mole per mole of non-photosensitive reducible silver salt.

The silver halide used in the present invention may be chemically and spectrally sensitized in a manner similar to that used to sensitize conventional wet-processed silver halide or state-of-the-art heat-developable photographic materials.

For example, it may be chemically sensitized with a chemical sensitizing agent, such as a compound containing sulfur, selenium, tellurium, etc., or a compound containing gold, platinum, palladium, ruthenium, rhodium, iridium, etc., a reducing agent such as a tin halide, etc., or a combination thereof. The details of these procedures are described in T. H. James, *The Theory of the Photographic Process,* Fourth Edition, Chapter 5, pp. 149 to 169. Suitable chemical sensitization procedures are also disclosed in Shepard, U.S. Pat. No. 1,623,499; Waller, U.S. Pat. No. 2,399,083; McVeigh, U.S. Pat. No. 3,297,447; and Dunn, U.S. Pat. No. 3,297,446.

Addition of sensitizing dyes to the photosensitive silver halides serves to provide them with high sensitivity to visible and infrared light by spectral sensitization. Thus, the photosensitive silver halides may be spectrally sensitized with various known dyes that spectrally sensitize silver halide. Non-limiting examples of sensitizing dyes that can be employed include cyanine dyes, merocyanine dyes, complex cyanine dyes, complex merocyanine dyes, holopolar cyanine dyes, hemicyanine dyes, styryl dyes, and hemioxanol dyes. Of these dyes, cyanine dyes, merocyanine dyes, and complex merocyanine dyes are particularly useful.

An appropriate amount of sensitizing dye added is generally about $10^{-10}$ to $10^{-1}$ mole; and preferably, about $10^{-8}$ to $10^{-3}$ moles per mole of silver halide.

Supersensitizers

To get the speed of the photothermographic elements up to maximum levels and further enhance sensitivity, it is often desirable to use supersensitizers. Any supersensitizer can be used which increases the sensitivity. For example, preferred infrared supersensitizers are described in U.S. patent application Ser. No. 07/846,919 and include heteroaromatic mercapto compounds or heteroaromatic disulfide compounds of the formula:

Ar—S—M

Ar—S—S—Ar wherein: M represents a hydrogen atom or an alkali metal atom.

In the above noted supersensitizers, Ar represents an aromatic ring or fused aromatic ring containing one or more of nitrogen, sulfur, oxygen, selenium or tellurium atoms. Preferably, the heteroaromatic ring is benzimidazole, naphthimidazole, benzothiazole, naphthothiazole, benzoxazole, naphthoxazole, benzoselenazole, benzotellurazole, imidazole, oxazole, pyrazole, triazole, thiadiazole, tetrazole, triazine, pyrimidine, pyridazine, pyrazine, pyridine, purine, quinoline or quinazolinone. However, other heteroaromatic rings are envisioned under the breadth of this invention.

The heteroaromatic ring may also carry substituents with examples of preferred substituents being selected from the group consisting of halogen (e.g., Br and Cl), hydroxy, amino, carboxy, alkyl (e.g., of 1 or more carbon atoms, preferably 1 to 4 carbon atoms) and alkoxy (e.g., of 1 or more carbon atoms, preferably of 1 to 4 carbon atoms.

Preferred supersensitizers are 2-mercaptobenzimidazole, 2-mercapto- 5-methylbenzimidazole, 2-mercaptobenzothiazole, and 2-mercaptobenzoxazole.

The supersensitizers are used in general amount of at least 0.001 moles of sensitizer per mole of silver in the emulsion layer. Usually the range is between 0.001 and 1.0 moles of the compound per mole of silver and preferably between 0.01 and 0.3 moles of compound per mole of silver.

The Non-Photosensitive Reducible Silver Source Material

When used in photothermographic and thermographic elements, the present invention includes a non-photosensitive reducible silver source. The non-photosensitive reducible silver source that can be used in the present invention can be any material that contains a source of reducible silver ions. Preferably, it is a silver salt which is comparatively stable to light and forms a silver image when heated to 80° C. or higher in the presence of an exposed photocatalyst (such as silver halide) and a reducing agent.

Silver salts of organic acids, particularly silver salts of long chain fatty carboxylic acids, are preferred. The chains typically contain 10 to 30, preferably 15 to 28, carbon atoms. Suitable organic silver salts include silver salts of organic compounds having a carboxyl group. Examples thereof include a silver salt of an aliphatic carboxylic acid and a silver salt of an aromatic carboxylic acid. Preferred examples of the silver salts of aliphatic carboxylic acids include silver behenate, silver stearate, silver oleate, silver laureate, silver caprate, silver myristate, silver palmitate, silver maleate, silver fumarate, silver tartarate, silver furoate, silver linoleate, silver butyrate, silver camphorate, and mixtures thereof, etc. Silver salts that can be substituted with a halogen atom or a hydroxyl group also can be effectively used. Preferred examples of the silver salts of aromatic carboxylic acid and other carboxyl group-containing compounds include: silver benzoate, a silver-substituted benzoate, such as silver 3,5-dihydroxybenzoate, silver o-methylbenzoate, silver m-methylbenzoate, silver p-methylbenzoate, silver 2,4-dichlorobenzoate, silver acetamidobenzoate, silver p-phenylbenzoate, etc.; silver gallate; silver tannate; silver phthalate; silver terephthalate; silver salicylate; silver phenylacetate; silver pyromellilate; a silver salt of 3-carboxymethyl-4-methyl- 4-thiazoline-2-thione or the like as described in U.S. Pat. No. 3,785,830; and a silver salt of an aliphatic carboxylic acid containing a thioether group as described in U.S. Pat. No. 3,330,663.

Silver salts of compounds containing mercapto or thione groups and derivatives thereof can also be used. Preferred examples of these compounds include: a silver salt of3-mercapto-4-phenyl-1,2,4-triazole; a silver salt of 2-mercaptobenzimidazole; a silver salt of 2-mercapto-5-aminothiadiazole; a silver salt of 2-(2-ethylglycolamido)benzothiazole; a silver salt of thioglycolic acid, such as a silver salt of a S-alkylthioglycolic acid (wherein the alkyl group has from 12 to 22 carbon atoms); a silver salt of a dithiocarboxylic acid such as a silver salt of dithioacetic acid; a silver salt of thioamide; a silver salt of 5-carboxylic-1-methyl- 2-phenyl-4-thiopyridine; a silver salt of mercaptotriazine; a silver salt of 2-mercaptobenzoxazole; a silver salt as described in U.S. Pat. No. 4,123,274, for example, a silver salt of a 1,2,4-mercaptothiazole derivative, such as a silver salt of 3-amino-5-benzylthio-1,2,4-thiazole; and a silver salt of a thione compound, such as a silver salt of 3-(2-carboxyethyl)-4-methyl-4-thiazoline-2-thione as disclosed in U.S. Pat. No. 3,201,678. Silver salts of acetylenes can also be used. Silver acetylides are described in U.S. Pat. Nos. 4,761,361 and 4,775,613.

Furthermore, a silver salt of a compound containing an imino group can be used. Preferred examples of these compounds include: silver salts of benzotriazole and substituted derivatives thereof, for example, silver methylbenzotriazole and silver 5-chlorobenzotriazole, etc.; silver salts of 1,2,4-triazoles or 1-H-tetrazoles as described in U.S. Pat. No. 4,220,709; and silver salts of imidazoles and imidazole derivatives.

It is also found convenient to use silver half soaps. A preferred example of a silver half soap is an equimolar blend of silver behenate and behenic acid, which analyzes for about 14.5% silver and which is prepared by precipitation from an aqueous solution of the sodium salt of commercial behenic acid.

Transparent sheet materials made on transparent film backing require a transparent coating. For this purpose a silver behenate full soap, containing not more than about 15% of free behenic acid and analyzing about 22% silver, can be used.

The method used for making silver soap dispersions is well known in the art and is disclosed in *Research Disclosure,* April 1983, item 22812, *Research Disclosure,* October 1983, item 23419, and U.S. Pat. No. 3,985,565.

The silver halide and the non-photosensitive reducible silver source material that form a starting point of development should be in catalytic proximity, i.e., reactive association. "Catalytic proximity" or "reactive association" means that they should be in the same layer, in adjacent layers, or in layers separated from each other by an intermediate layer having a thickness of less than 1 micrometer (1 μm). It is preferred that the silver halide and the non-photosensitive reducible silver source material be present in the same layer.

Photothermographic emulsions containing pre-formed silver halide in accordance with this invention can be sensitized with chemical sensitizers, or with spectral sensitizers as described above.

The source of reducible silver material generally constitutes about 5 to about 70% by weight of the emulsion layer. It is preferably present at a level of about 10 to about 50% by weight of the emulsion layer.

The Reducing Agent for the Non-Photosensitive Reducible Silver Source

When used in black-and-white photothermographic elements, the reducing agent for the organic silver salt may be any material, preferably organic material, that can reduce silver ion to metallic silver. Conventional photographic developers such as phenidone, hydroquinones, and catechol are useful, but hindered bisphenol reducing agents are preferred.

When the photothermographic element used in this invention containing a reducing agent for the non-photosensitive reducible silver source is heat developed, preferably at a temperature of from about 80° C. to about 250° C. (176° F. to 482° F.) for a duration of from about 1 second to about 2 minutes, in a substantially water-free condition after, or simultaneously with, imagewise exposure, a black-and-white silver image is obtained either in exposed areas or in unexposed areas with exposed photosensitive silver halide.

A wide range of reducing agents has been disclosed in dry silver systems including amidoximes, such as phenylamidoxime, 2-thienylamidoxime and p-phenoxy-phenylamidoxime; azines, such as 4-hydroxy-3,5-dimethoxybenzaldehydeazine; a combination of aliphatic carboxylic acid aryl hydrazides and ascorbic acid, such as 2,2'-bis(hydroxymethyl)propionyl-β-phenylhydrazide in combination with ascorbic acid; a combination of polyhydroxybenzene and hydroxylamine; a reductone and/or a hydrazine, such as a combination of hydroquinone and bis(ethoxyethyl)hydroxylamine, piperidinohexose reductone, or formyl-4-methylphenylhydrazine; hydroxamic acids, such as phenylhydroxamic acid, p-hydroxyphenylhydroxamic acid, and o-alaninehydroxamic acid; a combination of azines and sulfonamidophenols, such as phenothiazine with p-benzenesulfonamidophenol or 2,6-dichloro-4-benzenesulfonamidophenol; α-cyanophenylacetic acid derivatives, such as ethyl α-cyano-2-methylphenylacetate, ethyl α-cyano-phenylacetate; bis-o-naphthols, such as by 2,2'-dihydroxyl-1-binaphthyl, 6,6'-dibromo- 2,2'-dihydroxy- 1,1'-binaphthyl, and bis(2-hydroxy-1-naphthyl)methane; a combination of bis-o-naphthol and a 1,3-dihydroxybenzene derivative, such as 2,4-dihydroxybenzophenone or 2,4-dihydroxyacetophenone; 5-pyrazolones such as 3-methyl-1-phenyl-5-pyrazolone; reductones, such as dimethylaminohexose reductone, anhydrodihydroaminohexose reductone, and anhydrodihydropiperidone-hexose reductone; sulfonamidophemol reducing agents, such as 2,6-dichloro-4-benzenesulfonamidophenol and p-benzenesulfonamidophenol; indane-1,3-diones, such as 2-phenylindane-1,3-dione; chromans, such as 2,2-dimethyl-7-t-butyl-6-hydroxychroman; 1,4-dihydropyridines, such as 2,6-dimethoxy-3,5-dicarbethoxy-1,4-dihydropyridine; bisphenols, such as bis(2-hydroxy-3-t-butyl-5-methylphenyl)methane, 1,1-bis(2-hydroxy-3,5-dimethylphenyl)- 3,5,5-trimethylhexane, 2,2-bis(4-hydroxy-3-methylphenyl)propane, 4,4-ethylidene-bis(2-t-butyl-6-methylphenol), and 2,2-bis( 3,5-dimethyl-4-hydroxyphenyl)propane; ascorbic acid derivatives, such as 1-ascorbylpalmitate, ascorbylstearate; unsaturated aldehydes and ketones; certain 1,3-indanediones, and 3-pyrazolidones (phenidones).

The reducing agent should be present as 1 to 10% by weight of the imaging layer. In multilayer elements, if the reducing agent is added to a layer other than an emulsion layer, slightly higher proportions, of from about 2 to 15%, tend to be more desirable.

The Optional Dye-Forming or Dye-Releasing Material

As noted above, the reducing agent for the reducible source of silver may be a compound that can be oxidized directly or indirectly to form or release a dye.

When the photothermographic element used in this invention containing an optional dye-forming or dye-releasing material is heat developed, preferably at a temperature of from about 80° C. to about 250° C. (176° F. to 482° F.) for a duration of from about 1 second to about 2 minutes, in a substantially water-free condition after, or simultaneously with, imagewise exposure, a dye image is obtained simultaneously with the formation of a silver image either in exposed areas or in unexposed areas.

Leuco dyes are one class of dye-forming material that form a dye upon oxidation. Any leuco dye capable of being oxidized by silver ion to form a visible image can be used in the present invention. Leuco dyes that are both pH sensitive and oxidizable can also be used, but are not preferred. Leuco dyes that are sensitive only to changes in pH are not included within scope of dyes useful in this invention because they are not oxidizable to a colored form.

As used herein, a "leuco dye" or "blocked leuco dye" is the reduced form of a dye that is generally colorless or very lightly colored and is capable of forming a colored image upon oxidation of the leuco or blocked leuco dye to the dye form. Thus, the blocked leuco dyes (i.e., blocked dye-releasing compounds), absorb less strongly in the visible region of the electromagnetic spectrum than do the dyes. The resultant dye produces an image either directly on the sheet on which the dye is formed or, when used with a dye- or image-receiving layer, on the image-receiving layer upon diffusion through emulsion layers and interlayers.

Representative classes of leuco dyes that can used in the photothermographic elements of the present invention include, but are not limited to: chromogenic leuco dyes, such as indoaniline, indophenol, or azomethine leuco dyes; imidazole leuco dyes, such as 2-(3,5-di-t-butyl-4-hydroxyphenyl)-4,5-diphenylimidazole, as described in U.S. Pat. No. 3,985,565; dyes having an azine, diazine, oxazine, or thiazine nucleus such as those described in U.S. Pat. Nos. 4,563,415; 4,622,395; 4,710,570; and 4,782,010; and benzylidene leuco compounds as described in U.S. Pat. No. 4,923,792.

Another preferred class of leuco dyes useful in this invention are those derived from azomethine leuco dyes or indoaniline leuco dyes. These are often referred to herein as "chromogenic leuco dyes" because many of these dyes are useful in conventional, wet-processed photography. Chromogenic dyes are prepared by oxidative coupling of a p-phenylenediamine compound or a p-aminophenol compound with a photographic-type coupler. Reduction of the corresponding dye as described, for example, in U.S. Pat. No. 4,374,921 forms the chromogenic leuco dye. Leuco chromogenic dyes are also described in U.S. Pat. No. 4,594,307. Cyan leuco chromogenic dyes having short chain carbamoyl protecting groups are described in European Laid Open patent application No. 533,008. For a review of chromogenic leuco dyes, see K. Venkataraman, *The Chemistry of Synthetic Dyes,* Academic Press: New York, 1952; Vol. 4, Chapter VI.

Another class of leuco dyes useful in this invention are "aldazine" and "ketazine" leuco dyes. Dyes of this type are described in U.S. Pat. Nos. 4,587,211 and 4,795,697. Benzylidene leuco dyes are also useful in this invention. Dyes of this type are described in U.S. Pat. No. 4,923,792.

Yet another class of dye-releasing materials that form a diffusible dye upon oxidation are known as pre-formed-dye-release (PDR) or redox-dye-release (RDR) materials. In these materials, the reducing agent for the organic silver compound releases a mobile pre-formed dye upon oxidation. Examples of these materials are disclosed in Swain, U.S. Pat. No. 4,981,775.

Further, as other image-forming materials, materials where the mobility of the compound having a dye part changes as a result of an oxidation-reduction reaction with silver halide, or an organic silver salt at high temperature can be used, as described in Japanese patent application No. 165,054/84.

Still further the reducing agent may be a compound that releases a conventional photographic dye coupler or developer on oxidation as is known in the art.

The dyes formed or released in the various color-forming layers should, of course, be different. A difference of at least 60 nm in reflective maximum absorbance is preferred. More preferably, the absorbance maximum of dyes formed or released will differ by at least 80–100 nm. When three dyes are to be formed, two should preferably differ by at least these minimums, and the third should preferably differ from at least one of the other dyes by at least 150 nm, and more preferably, by at least 200 nm. Any reducing agent capable of being oxidized by silver ion to form or release a visible dye is useful in the present invention as previously noted.

The total amount of optional leuco dye used as a reducing agent used in the present invention should preferably be in the range of 0.5–25 wt. %, and more preferably, in the range of 1–10 wt. %, based upon the total weight of each individual layer in which the reducing agent is employed.

The Binder

The photosensitive silver halide, the non-photosensitive reducible source of silver, the reducing agent system, and any other addenda used in the present invention are generally added to at least one binder. The binder(s) that can be used in the present invention can be employed individually or in combination with one another. It is preferred that the binder be selected from polymeric materials, such as, for example, natural and synthetic resins that are sufficiently polar to hold the other ingredients in solution or suspension.

A typical hydrophilic binder is a transparent or translucent hydrophilic colloid. Examples of hydrophilic binders include: a natural substance, for example, a protein such as gelatin, a gelatin derivative, a cellulose derivative, etc.; a polysaccharide such as starch, gum arabic, pullulan, dextrin, etc.; and a synthetic polymer, for example, a water-soluble polyvinyl compound such as polyvinyl alcohol, polyvinyl pyrrolidone, acrylamide polymer, etc. Another example of a hydrophilic binder is a dispersed vinyl compound in latex form which is used for the purpose of increasing dimensional stability of a photographic element.

Examples of typical hydrophobic binders are polyvinyl acetals, polyvinyl chloride, polyvinyl acetate, cellulose acetate, polyolefins, polyesters, polystyrene, polyacrylonitrile, polycarbonates, methacrylate copolymers, maleic anhydride ester copolymers, butadiene-styrene copolymers, and the like. Copolymers, e.g., terpolymers, are also included in the definition of polymers. The polyvinyl acetals, such as polyvinyl butyral and polyvinyl formal, and vinyl copolymers such as polyvinyl acetate and polyvinyl chloride are particularly preferred.

Although the binder can be hydrophilic or hydrophobic, preferably it is hydrophobic in the silver containing layer(s). Optionally, these polymers may be used in combination of two or more thereof.

The binders are preferably used at a level of about 30–90% by weight of the emulsion layer, and more preferably at a level of about 45–85% by weight. Where the proportions and activities of the reducing agent system for the non-photosensitive reducible source of silver require a particular developing time and temperature, the binder should be able to withstand those conditions. Generally, it is preferred that the binder not decompose or lose its structural integrity at 250° F. (121 ° C.) for 60 seconds, and more preferred that it not decompose or lose its structural integrity at 350° F. (177° C.) for 60 seconds.

The polymer binder is used in an amount sufficient to carry the components dispersed therein, that is, within the effective range of the action as the binder. The effective range can be appropriately determined by one skilled in the art.

Photothermographic and Thermographic Formulations

The formulation for the photothermographic and thermographic emulsion layer can be prepared by dissolving and dispersing the binder, the photosensitive silver halide (when used), the non-photosensitive reducible source of silver, the reducing agent system for the non-photosensitive reducible silver source, and optional additives, in an inert organic solvent, such as, for example, toluene, 2-butanone, or tetrahydrofuran.

The use of "toners" or derivatives thereof which improve the image, is highly desirable, but is not essential to the element. Toners can be present in an amount of about 0.01–10% by weight of the emulsion layer, preferably about 0.1–10% by weight. Toners are well known materials in the photothermographic art, as shown in U.S. Pat. Nos. 3,080,254; 3,847,612; and 4,123,282.

Examples of toners include: phthalimide and N-hydroxyphthalimide; cyclic imides, such as succinimide, pyrazoline-5-ones, quinazolinone, 1-phenylurazole, 3-phenyl-2-pyrazoline-5-one, and 2,4-thiazolidinedione; naphthalimides, such as N-hydroxy-1,8-naphthalimide; cobalt complexes, such as cobaltic hexamine trifluoroacetate; mercaptans such as 3-mercapto-1,2,4-triazole, 2,4-dimercaptopyrimidine, 3-mercapto-4,5-diphenyl-1,2,4-triazole and 2,5-dimercapto-1,3,4-thiadiazole; N-(aminomethyl)aryldicarboximides, such as (N,N-dimethylaminomethyl)phthalimide, and N-(dimethylaminomethyl)naphthalene-2,3-dicarboximide; a combination of blocked pyrazoles, isothiuronium derivatives, and certain photobleach agents, such as a combination of N,N'-hexamethylene-bis(1-carbamoyl- 3,5-dimethylpyrazole), 1,8-(3,6-diazaoctane)bis(isothiuronium)trifluoroacetate, and 2-(tribromomethylsulfonyl benzothiazole); merocyanine dyes such as 3-ethyl- 5-[(3-ethyl-2-benzothiazolinylidene)-1-methyl-ethylidene]-2-thio- 2,4-o-azolidinedione; phthalazinone, phthalazinone derivatives, or metal salts or these derivatives, such as 4-(1-naphthyl)phthalazinone, 6-chlorophthalazinone, 5,7-dimethoxyphthalazinone, and 2,3-dihydro-1,4-phthalazinedione; a combination of phthalazine plus one or more phthalic acid derivatives, such as phthalic acid, 4-methylphthalic acid, 4-nitrophthalic acid, and tetrachlorophthalic anhydride, quinazolinediones, benzoxazine or naphthoxazine derivatives; rhodium complexes functioning not only as tone modifiers but also as sources of halide ion for silver halide formation in situ, such as ammonium hexachlororhodate (III), rhodium bromide, rhodium nitrate, and potassium hexachlororhodate (III); inorganic peroxides and persulfates, such as ammonium peroxydisulfate and hydrogen peroxide; benzoxazine-2,4-diones, such as 1,3-benzoxazine-2,4-dione, 8-methyl- 1,3 -benzoxazine-2,4-dione, and 6-nitro- 1,3 -benzoxazine-2,4-dione; pyrimidines and asym-triazines, such as 2,4-dihydroxypyrimidine, 2-hydroxy-4-aminopyrimidine, and azauracil; and tetrazapentalene derivatives, such as 3,6-dimercapto-1,4-diphenyl- 1H, 4H-2,3*a*,5,6*a*-tetraazapentalene and 1,4-di-(o-chlorophenyl)-3,6-dimercapto- 1H, 4H-2,3*a*,5,6*a*-tetraazapentalene.

The photothermographic elements used in this invention can be further protected against the additional production of fog and can be stabilized against loss of sensitivity during storage. While not necessary for the practice of the invention, it may be advantageous to add mercury (II) salts to the emulsion layer(s) as an antifoggant. Preferred mercury (II) salts for this purpose are mercuric acetate and mercuric bromide.

Other suitable antifoggants and stabilizers, which can be used alone or in combination, include the thiazolium salts described in U.S. Pat. Nos. 2,13 1,038 and U.S. Pat. No. 2,694,716; the azaindenes described in U.S. Pat. Nos. 2,886,437; the triazaindolizines described in U.S. Pat. No. 2,444,605; the mercury salts described in U.S. Pat. No. 2,728,663; the urazoles described in U.S. Pat. No. 3,287, 135; the sulfocatechols described in U.S. Pat. No. 3,235,652; the oximes described in British Pat. No. 623,448; the polyvalent metal salts described in U.S. Pat. No. 2, 839,405; the thiuronium salts described in U.S. Pat. No. 3,220,839; and palladium, platinum and gold salts described in U.S. Pat. Nos. 2,566,263 and 2,597,915.

Photothermographic and thermographic elements of the invention can contain plasticizers and lubricants such as polyalcohols and diols of the type described in U.S. Pat. No. 2,960,404; fatty acids or esters, such as those described in U.S. Pat. Nos. 2,588,765 and 3,121,060; and silicone resins, such as those described in British Patent No. 955,061.

Photothermographic and thermographic elements containing emulsion layers described herein may contain matting agents such as starch, titanium dioxide, zinc oxide, silica, and polymeric beads including beads of the type described in U.S. Pat. Nos. 2,992,101 and 2,701,245.

Emulsions in accordance with this invention may be used in photothermographic and thermographic elements which contain antistatic or conducting layers, such as layers that comprise soluble salts, e.g., chlorides, nitrates, etc., evaporated metal layers, ionic polymers such as those described in U.S. Pat. Nos. 2,861,056, and 3,206,312 or insoluble inorganic salts such as those described in U.S. Pat. No. 3,428,451.

Photothermographic and Thermographic Constructions

The photothermographic and thermographic elements of this invention may be constructed of one or more layers on a support. Single layer constructions should contain the silver halide (when used), the non-photosensitive, reducible silver source material, the reducing agent system for the non-photosensitive reducible silver source, the binder as well as optional materials such as toners, acutance dyes, coating aids, and other adjuvants.

Two-layer constructions should contain silver halide (when used) and non-photosensitive, reducible silver source in one emulsion layer (usually the layer adjacent to the support) and some of the other ingredients in the second layer or both layers, although two layer constructions comprising a single emulsion layer coating containing all the ingredients and a protective topcoat are envisioned.

Barrier layers, preferably comprising a polymeric material, can also be present in the photothermographic element of the present invention. Polymers for the material of the barrier layer can be selected from natural and synthetic polymers such as gelatin, polyvinyl alcohols, polyacrylic acids, sulfonated polystyrene, and the like. The polymers can optionally be blended with barrier aids such as silica.

Photothermographic and thermographic emulsions used in this invention can be coated by various coating procedures including wire wound rod coating, dip coating, air knife coating, curtain coating, or extrusion coating using hoppers of the type described in U.S. Pat. No. 2,681,294. If desired, two or more layers can be coated simultaneously by the procedures described in U.S. Pat. No. 2,761,791 and British Patent No. 837,095. Typical wet thickness of the emulsion layer can be about 10–150 micrometers (μm), and the layer can be dried in forced air at a temperature of about 20°–100° C. It is preferred that the thickness of the layer be selected to provide maximum image densities greater than 0.2, and, more preferably, in the range 0.5 to 4.5, as measured by a MacBeth Color Densitometer Model TD 504 using the color filter complementary to the dye color.

Photothermographic elements according to the present invention can contain acutance dyes and antihalation dyes. The dyes may be incorporated into the photothermographic emulsion layer as acutance dyes according to known techniques. The dyes may also be incorporated into antihalation layers according to known techniques as an antihalation backing layer, an antihalation underlayer or as an overcoat. It is preferred that the photothermographic elements of this invention contain an antihalation coating on the support opposite to the side on which the emulsion and topcoat layers are coated. Antihalation and acutance dyes useful in the present invention are described in U.S. Pat. Nos. 5,135,842; 5,226,452; and 5,314,795.

Development conditions will vary, depending on the construction used, but will typically involve heating the imagewise exposed material at a suitably elevated temperature. When used in a photothermographic element, the latent image obtained after exposure of the heat-sensitive element can be developed by heating the material at a moderately elevated temperature of, for example, about 80°–250° C., preferably about 100°–200° C., for a sufficient period of time, generally about 1 second to about 2 minutes. Heating may be carried out by the typical heating means such as a hot plate, an iron, a hot roller, a heat generator using carbon or titanium white, or the like.

If desired, the imaged element may be subjected to a first heating step at a temperature and for a time sufficient to intensify and improve the stability of the latent image but insufficient to produce a visible image and later subjected to a second heating step at a temperature and for a time sufficient to produce the visible image. Such a method and its advantages are described in U.S. Pat. No. 5,279,928.

When used in a thermographic element, the image may be developed merely by heating at the above noted temperatures using a thermal stylus or print head, or by heating while in contact with a heat absorbing material.

Thermographic elements of the invention may also include a dye to facilitate direct development by exposure to laser radiation. Preferably the dye is an infrared absorbing dye and the laser is a diode laser emitting in the infrared. Upon exposure to radiation the radiation absorbed by the dye is converted to heat which develops the thermographic element.

The photothermographic and thermographic elements of this invention may also contain electroconductive underlayers to reduce static electricity effects and improve transport through processing equipment. Such layers are described in U.S. Pat. No. 5,310,640.

The Support

Photothermographic and thermographic emulsions used in the invention can be coated on a wide variety of supports. The support, or substrate, can be selected from a wide range of materials depending on the imaging requirement. Supports may be transparent or at least translucent. Typical supports include polyester film, subbed polyester film (e.g., polyethylene terephthalate or polyethylene naphthalate), cellulose acetate film, cellulose ester film, polyvinyl acetal film, polyolefinic film (e.g., polethylene or polypropylene or blends thereof), polycarbonate film and related or resinous materials, as well as glass, paper, and the like. Typically, a flexible support is employed, especially a polymeric film support, which can be partially acetylated or coated, particularly with a polymeric subbing or priming agent. Preferred polymeric materials for the support include polymers having good heat stability, such as polyesters. Particularly preferred polyesters are polyethylene terephthalate and polyethylene naphthalate.

A support with a backside resistive heating layer can also be used photothermographic imaging systems such as shown in U.S. Pat. No. 4,374, 921.

The Image-Receiving Layer

When the reactants and reaction products of photothermographic and thermographic systems that contain compounds capable of being oxidized to form or release a dye remain in contact after imaging, several problems can result. For example, thermal development often forms turbid and hazy color images because of dye contamination by the reduced metallic silver image on the exposed area of the emulsion. In addition, the resulting prints tend to develop color in unimaged background areas. This is often referred to as "leuco dye backgrounding." This "background stain" is caused by slow post-processing reaction between the dye-forming or dye-releasing compound and reducing agent. It is therefore desirable to transfer the dye formed upon imaging to a receptor, or image-receiving layer.

Thus, the photothermographic or thermographic element may further comprise an image-receiving layer. Images derived from the photothermographic elements employing compounds capable of being oxidized to form or release a dye, such as, as for example, leuco dyes, are typically transferred to an image-receiving layer.

If used, dyes generated during thermal development of light-exposed regions of the emulsion layers migrate under development conditions into the an image-receiving or dye-receiving layer wherein they are retained. The dye-receiving layer may be composed of a polymeric material having affinity for the dyes employed. Necessarily, it will vary depending on the ionic or neutral characteristics of the dyes.

The image-receiving layer can be any flexible or rigid, transparent layer made of thermoplastic polymer. The image-receiving layer preferably has a thickness of at least 0.1 μm more preferably from about 1–10 μm, and a glass transition temperature ($T_g$) of from about 20° C. to about 200° C. In the present invention, any thermoplastic polymer or combination of polymers can be used, provided the polymer is capable of absorbing and fixing the dye. Because the polymer acts as a dye mordant, no additional fixing agents are required. Thermoplastic polymers that can be used to prepare the image-receiving layer include polyesters, such as polyethylene terephthalates; polyolefins, such as polyethylene; cellulosics, such as cellulose acetate, cellulose butyrate, cellulose propionate; polystyrene; polyvinyl chloride; polyvinylidine chloride; polyvinyl acetate; copolymer of vinyl chloride-vinyl acetate; copolymer of vinylidene chloride-acrylonitrile; copolymer of styrene-acrylonitrile; and the like.

The optical density of the dye image and even the actual color of the dye image in the image-receiving layer is very much dependent on the characteristics of the polymer of the image-receiving layer, which acts as a dye mordant, and, as such, is capable of absorbing and fixing the dyes. A dye image having a reflection optical density in the range of from 0.3 to 3.5 (preferably, from 1.5 to 3.5) or a transmission optical density in the range of from 0.2 to 2.5 (preferably, from 1.0 to 2.5) is desirable.

The image-receiving layer can be formed by dissolving at least one thermoplastic polymer in an organic solvent (e.g., 2-butanone, acetone, tetrahydrofuran) and applying the resulting solution to a support base or substrate by various coating methods known in the art, such as curtain coating, extrusion coating, dip coating, air-knife coating, hopper coating, and any other coating method used for coating solutions. After the solution is coated, the image-receiving layer is dried (e.g., in an oven) to drive off the solvent. The image-receiving layer may be strippably adhered to the photothermographic element. Strippable image-receiving layers are described in U.S. Pat. No. 4,594,307.

Selection of the binder and solvent to be used in preparing the emulsion layer significantly affects the strippability of the image-receiving layer from the photosensitive element. Preferably, the binder for the image-receiving layer is impermeable to the solvent used for coating the emulsion layer and is incompatible with the binder used for the emulsion layer. The selection of the preferred binders and solvents results in weak adhesion between the emulsion layer and the image-receiving layer and promotes good strippability of the emulsion layer.

The photothermographic element can also include coating additives to improve the strippability of the emulsion layer.

For example, fluoroaliphatic polyesters dissolved in ethyl acetate can be added in an amount of from about 0.02–0.5 wt. % of the emulsion layer, preferably from about 0.1–0.3 wt. %. A representative example of such a fluoroaliphatic polyester is Fluorad™ FC 431, (a fluorinated surfactant available from 3M Company, St. Paul, Minn.). Alternatively, a coating additive can be added to the image-receiving layer in the same weight range to enhance strippability. No solvents need to be used in the stripping process. The strippable layer preferably has a delaminating resistance of 1 to 50 g/cm and a tensile strength at break greater than, preferably at least two times greater than, its delaminating resistance.

Preferably, the image-receiving layer is adjacent to the emulsion layer in order to facilitate transfer of the dye that forms after the imagewise exposed emulsion layer is subjected to thermal development, for example, in a heated shoe-and-roller-type heat processor.

Photothermographic multi-layer constructions containing blue-sensitive emulsions containing a yellow dye-forming or dye-releasing compound can be overcoated with green-sensitive emulsions containing a magenta dye-forming or dye-releasing compound. These layers can in turn be overcoated with a red-sensitive emulsion layer containing a cyan dye-forming or dye-releasing compound. Imaging and heating to form or release the yellow, magenta, and cyan dyes in an imagewise fashion. The dyes so formed or released may migrate to an image-receiving layer. The image-receiving layer can be a permanent part of the construction or it can be removable, "i.e., strippably adhered," and subsequently peeled from the construction. Color-forming layers can be maintained distinct from each other by the use of functional or non-functional barrier layers between the various photosensitive layers as described in U.S. Pat. No. 4,460,681. False color address, such as that shown in U.S. Pat. No. 4,619,892, can also be used rather than blue-yellow, green-magenta, or red-cyan relationships between sensitivity and dye formation or release. False color address is particularly useful when imaging is performed using longer wavelength light sources, especially red or near infrared light sources, to enable digital address by lasers and laser diodes.

If desired, the dyes formed or released in the emulsion layer can be transferred onto a separately coated image-receiving sheet by placing the exposed emulsion layer in intimate face-to-face contact with the image-receiving sheet and heating the resulting composite construction. Good results can be achieved in this second embodiment when the layers are in uniform contact for a period of time of about 0.5–300 seconds at a temperature of about 80°–220° C.

In another embodiment, a multi-colored image can be prepared by super-imposing in register a single image-receiving sheet successively with two or more imagewise exposed photothermographic elements, each of which forms or releases a dye of a different color, and heating to transfer the thus formed or released dyes as described above. This method is particularly suitable for the production of color proofs especially when the dyes formed or released have hues that match the internationally agreed standards for color reproduction (Standard Web Offset Printing colors or SWOP colors). Dyes with this property are disclosed in U.S. Pat. No. 5,023,229. In this embodiment, the photothermographic elements are preferably all sensitized to the same wavelength range regardless of the color of the dye formed or released. For example, the elements can be sensitized to ultraviolet radiation with a view toward contact exposure on conventional printing frames, or they can be sensitized to longer wavelengths, especially red or near infra-red, to enable digital address by lasers and laser diodes. As noted above, false color address is again particularly useful when imaging is performed using longer wavelength light sources, especially red or near infrared light sources, to enable digital address by lasers and laser diodes.

Use as a Photomask

As noted above, the possibility of low absorbance of the photothermographic element in the range of 350–450 nm in non-imaged areas facilitates the use of the photothermographic and thermographic elements of the present invention in a process where there is a subsequent exposure of an ultraviolet or short wavelength visible radiation sensitive imageable medium. For example, imaging the photothermographic or thermographic element with coherent radiation and subsequent development affords a visible image. The developed photothermographic or thermographic element absorbs ultraviolet or short wavelength visible radiation in the areas where there is a visible image and transmits ultraviolet or short wavelength visible radiation where there is no visible image. The developed element may then be used as a mask and placed between an ultraviolet or short wavelength visible radiation energy source and an ultraviolet or short wavelength visible radiation photosensitive imageable medium such as, for example, a photopolymer, diazo material, or photoresist. The process is particularly useful where the imageable medium comprises a printing plate and the photothermographic or thermographic element serves as an imagesetting film.

Reasonable modifications and variations are possible from the foregoing disclosure without departing from either the spirit or scope of the invention as defined by the claims. Objects and advantages of this invention will now be illustrated by the following examples, but the particular materials and amounts thereof recited in these examples, as well as other conditions and details, should not be construed to unduly limit this invention.

EXAMPLES

All materials used in the following examples are readily available from standard commercial sources, such as Aldrich Chemical Co. (Milwaukee, Wis.), unless otherwise specified. All percentages are by weight unless otherwise indicated. The following additional terms and materials were used.

Acryloid™ A-21 is an acrylic copolymer available from Rohm and Haas, Philadelphia, Pa.

Butvar™ B-79 is a polyvinyl butyral resin available from Monsanto Company, St. Louis, Mo.

CAB 171-15S is a cellulose acetate butyrate resin available from Eastman Kodak Co.

CBB A is 2-(4-chlorobenzoyl)benzoic acid.

MEK is methyl ethyl ketone (2-butanone).

MeOH is methanol.

MMBI is 5-methyl-2-mercaptobenzimidazole.

Permanax™ WSO is 1,1-bis(2-hydroxy-3,5-dimethylphenyl)-3,5,5-trimethylhexane [CAS RN=7292-14-0] and is available from St-Jean PhotoChemicals, Inc. Quebec. It is a reducing agent (i.e., a hindered phenol developer) for the non-photosensitive reducible source of silver. It is also known as Nonox.

PET is polyethylene terephthalate.

PHP is pyridinium hydrobromide perbromide.

PHZ is phthalazine.

TCPA is tetrachlorophthalic acid.

Dye-1 is described in U.S. Pat. No. 5,393,654 and has the structure shown below.

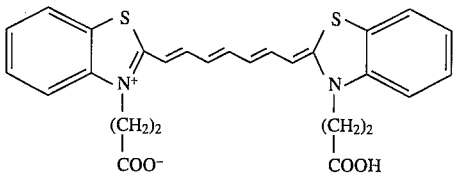

Antifoggant A is 2-(tribromomethylsulfonyl)quinoline. Its preparation is disclosed in U.S. Pat. No. 5,460,938. It has the following structure:

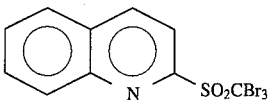

Et-FOSEMA is an abbreviation for N-ethylperfluorooctanesulfonamidoethyl methacrylate and has the formula $C_8F_{17}SO_2N(C_2H_5)CH_2CH_2OCOC(CH_3)=CH_2$. It is available from 3M Company, St. Paul, Minn.

HEMA is an abbreviation for hydroxyethyl methacrylate and has the formula $HOCH_2CH_2OC(CH_3)=CH_2$. It is available from 3M Company, St. Paul, Minn.

AA is an abbreviation for acrylic acid and has the formula $HO_2CCH=CH_2$.

Preparation of Surfactants

The following represents a typical preparation of a surfactant of the invention. Other surfactants were prepared in a similar manner by substituting appropriate materials.

A copolymer surfactant of Et-FOSEMA/AA was prepared by dissolving 24.0 g of a 75 wt. % solution of Et-FOSEMA in acetone (net 18.0 g, 0.028 mol of Et-FOSEMA), 2.0 g (0.028 tool) of acrylic acid, 1.0 g of t-butylperoctoate (North America Atochem, Philadelphia, Pa.) and 0.8 g of 3-mercapto-1,2-propanediol in 108 g of 2-butanone. The polymerization solution was purged with nitrogen through a dip tube for two minutes and then sealed. The sealed bottle was shaken at 90° C. for 4–5 hours. The bottle was removed from the shaker, allowed to cool to room temperature, and air was admitted.

The wt. % of polymer was determined by placing a known weight of polymer solution in a weighing dish, placing the dish in a forced air oven at 100° C. for 1 hour and reweighing the residue.

Table 1 below shows the net weight of Et-FOSEMA and acrylic acid used to prepare different polymers of this invention having various wt. % of Et-FOSEMA and acrylic acid. All reactions were run in an analogous manner to that described above.

TABLE 1

| Sample | wt % monomers | Et-FOSEMA | acrylic acid |
|---|---|---|---|
| 1 | 90/10 | 18.0g | 2.0g |
| 2 | 70/30 | 14.0g | 6.0g |
| 3 | 50/50 | 10.0g | 10.08 |
| 4 | 35/65 | 7.0g | 13.0g |
| 5 | 20/80 | 4.0g | 16.0g |

Large Scale Preparation of Surfactant Polymer Sample 3

A five liter flask fitted with overhead stirrer, thermometer, addition funnel and reflux condenser was purged with dry nitrogen for 15 minutes. The mixture was kept under slight positive pressure of nitrogen throughout the reaction. A monomer solution of 302 g of Et-FOSEMA (75 wt. % in acetone, net 226.5 g, 0.354 mol of Et-FOSEMA), 227 g (3.15 mol) of acrylic acid, and 23 g of t-butyl peroctoate in 250 g of 2-butanone was prepared and placed in the addition funnel. 2-Butanone (2,000 g) and 25 g of 3-mercapto-1,2-propanediol were added to the flask and the flask heated to 80° C. The monomer solution contained in the addition funnel was added to the flask all at once. The addition funnel was rinsed with an additional 250 g of 2-butanone. The reaction mixture was heated for 4 hours at 80° C. Air was admitted to the flask, the reaction mixture was cooled to room temperature, and poured into bottles for storage.

EXAMPLES 1–6

Examples 1–6 demonstrate the use of fluorochemical surfactants of this invention in the preparation and use of photothermographic elements with reduced mottle.

A dispersion of silver behenate pre-formed soap was made by combining silver behenate, Butvar™ B-79 polyvinyl butyral, toluene, and 2-butanone in the ratios shown below.

| Component | Weight Percent (wt %) |
|---|---|
| Silver behenate | 20.8% |
| polyvinyl butyral | 2.2% |
| toluene | 1.0% |
| 2-butanone | 76.0% |

A silver solution was prepared by adding 36.26 g of 2-butanone and a premix of 0.28 g of pyridinium hydrobromide perbromide in 1.57 g of methanol to 382.99 g of the pre-formed silver soap dispersion. After 30 minutes of mixing, 2.83 g of a 15.0 wt. % solution of calcium bromide in methanol was added and mixed for 15 minutes. A solution of 0.26 g 2-mercapto-5-methylbenzimidazole, 2.92 g of 2-(4-chlorobenzoyl)benzoic acid, 0.054 g of Dye 1, and 19.15 g of methanol was then added. After mixing for 15 minutes, 91.07 g of Butvar™ B-79 polyvinyl butyral was added and the mixing continued for 30 minutes. After the resin had dissolved, a premix of 2.26 g of Antifoggant A (2-(tribromomethyl)sulfonyl quinoline) in 26.02 g of 2-butanone was added and allowed to mix for 10 minutes. Nonox m (21.76 g) was added and mixed for 10 minutes. A 26.0% solution of tetrachlorophthalic acid in 2-butanone was added and mixed for 10 minutes. Finally a solution of 2.16 g of phthalzine in 7.64 g of 2-butanone was added and mixed for 15 minutes.

A topcoat solution was prepared by dissolving 1.72 g of phthalic acid in 41.44 g of methanol. After adding 240.33 g of 2-butanone, 0.46 g of tetrachlorophthalic acid was added and mixed until it dissolved. Then 49.90 g of CAB 171-15S cellulose acetate butyrate resin was added and mixed for 1 hour. After the resin had dissolved, a solution of 264.4 g of 2-butanone and 1.92 g of Acryloid™ A21 acrylic resin was added and mixed for 15 minutes.

A dual-knife coater was used to coat the dispersions. This apparatus consists of two knife coating blades in series. The support used was 7 mil polyethylene terephthalate. The knives were lowered and locked into place above the support. The height of the knives was adjusted with wedges controlled by screw knobs and measured with electronic gauges. Knife #1 was raised to a clearance corresponding to the thickness of the support plus the desired wet thickness of layer #1. Knife #2 was raised to a height equal to the desired thickness of the support plus the desired wet thickness of layer #1 plus the desired wet thickness of layer #2. The first knife gap was set to 3.8 mils (95.5 μm) above the support and the second knife gap was set to 5.8 mils (147 μm) above the support.

Aliquots of the silver dispersion and topcoat solution were simultaneously poured onto the support in front of the corresponding knives. The support was immediately drawn past the knives and into an oven to produce a double layered coating. The coated photothermographic material was then dried by taping the support to a belt which was rotated inside a "BlueM" oven maintained at 80° C. for approximately 2.5 minutes.

The film was then exposed to reflected white light at low intensity and processed using a hot roll at approximately 255° F. It was visually inspected for mottle and given a rating between 0 and 5. A level 0 had severe mottle, equal to films coated without any surfactant. A level of 5 represents a coating with no mottle. The ratings are listed in Table 2 below.

The topcoat was then split into 7 batches. To each of these, a surfactant listed in Table 2 was added so that the amount of surfactant equaled 0.1 wt. % of the total solution. The results, shown below in Table 2, demonstrate the usefulness in reducing mottle of the copolymers of this invention with a ratio of from about 90/10 to about 20/80 wt. % of fluorinated, ethylenically unsaturated monomer and polar ethylenically unsaturated monomer. The results further demonstrate the preferred usefulness in reducing mottle of copolymers of this invention with a ratio of from about 70/30 to about 35/65 wt. % of fluorinated, ethylenically unsaturated monomer and polar ethylenically unsaturated monomer. It appears that a ratio of from about 35/65 to about 50/50 wt. % of fluorinated, ethylenically unsaturated monomer and polar ethylenically unsaturated monomer is near the optimum for reducing mottle.

Example 6 demonstrates that the surfactants of this invention reduce mottle better than the surfactants of U.S. Pat. No. 5,380,644. In Example 2, column 25, line 60 of that patent, removal of the AA moiety to form an Et-FOSEMA/HEMA copolymer resulted in a surfactant that was unable to reduce mottle. It is surprising, therefore, that the removal of the HEMA to form an Et-FOSEMA/AA copolymer is effective in reducing mottle.

TABLE 2

| | Surfactants used | |
|---|---|---|
| Example | Wt % Et-FOSEMA/AA | Mottle Rating |
| 1 | 90/10 | 1.5* |
| 2 | 70/30 | 1.5* |
| 3 | 50/50 | 5 |
| 4 | 35/65 | 4 |
| 5 | 20/80 | 1 |
| 6 | 70/20/10** | 2 |

*Average of 2 samples
**Terpolymer of Et-FOSEMA/HEMA/AA as disclosed in U.S. Pat. No. 5,380,644

Reasonable modifications and variations are possible from the foregoing disclosure without departing from either the spirit or scope of the present invention as defined by the claims.

What we claim is:

1. A photothermographic element comprising a substrate coated with a photothermographic composition comprising:

(a) a photosensitive silver halide;

(b) a non-photosensitive, reducible source of silver;

(c) a reducing agent for the non-photosensitive, reducible source of silver;

(d) a binder; and (e) a fluorinated polymer consisting essentially of two different groups within the polymer chain derived from reactive monomers, the monomers consisting essentially of:

(i) at least one fluorinated, ethylenically unsaturated monomer; and (ii) at least one polar ethylenically unsaturated monomer, wherein the ratio of said at least one fluorinated, ethylenically unsaturated monomer to said at least one polar ethylenically unsaturated monomer is in the range of about 35/65 to about 50/50.

2. The photothermographic element according to claim 1 wherein silver halide is silver bromide, silver chloride, or silver iodide or mixtures thereof.

3. The photothermographic element according to claim 1 wherein said non-photosensitive, reducible source of silver is a silver salt of a carboxylic acid having 1 to 30 carbon atoms.

4. The photothermographic element according to claim 1 wherein said reducing agent is a compound capable of being oxidized to form or release a dye.

5. The photothermographic element according to claim 4 wherein said compound capable of being oxidized to form or release a dye is a leuco dye.

6. The photothermographic element according to claim 1 wherein said binder is hydrophilic.

7. The photothermographic element according to claim 1 wherein said binder is hydrophobic.

8. The photothermographic element according to claim 1 wherein said fluorinated polymer has a weight average molecular weight in the range of about 2,000 to 20,000.

9. The photothermographic element according to claim 8 wherein said fluorinated polymer has a weight average molecular weight in the range of about 2,800 to 7,000.

10. The photothermographic element according to claim 1 wherein the fluorinated polymer is the acrylic reaction product of at least one fluorinated ethylenically unsaturated monomer and at least one polar ethylenically unsaturated monomer.

11. A process for the formation of a visible image comprising exposing the photothermographic element of claim 1 to light to form a latent image and subsequently heating said exposed element.

12. A thermographic element comprising a substrate coated with a thermographic composition comprising:

(a) a non-photosensitive, reducible source of silver;

(b) a reducing agent for the non-photosensitive, reducible source of silver (c) a binder; and (d) a fluorinated polymer consisting essentially of at least two different groups within the polymer chain derived from reactive monomers, the monomers consisting essentially of:

(i) at least one fluorinated, ethylenically unsaturated monomer; and (ii) at least one polar ethylenically unsaturated monomer, wherein the ratio of said at least one fluorinated, ethylenically unsaturated monomer to said at least one polar ethylenically unsaturated monomer is in the range of about 35/65 to about 50/50 wt.%.

13. A thermographic element according to claim 12 wherein said photosensitive, reducible source of silver is a silver salt of a carboxylic acid having 1 to 30 carbon atoms.

14. The thermographic element according to claim 12 wherein said reducing agent is a compound capable of being oxidized to form or release a dye.

15. The thermographic element according to claim 14 wherein said reducing agent capable of being oxidized to form or release a dye is a leuco dye.

16. The thermographic element according to claim 12 wherein said binder is hydrophilic.

17. The thermographic element according to claim 12 wherein said binder is hydrophobic.

18. The thermographic element according to claim 12 wherein said polar ethylenically monomer has a weight average molecular weight in the range of about 2,000 to 20,000.

19. The thermographic element according to claim 18 wherein said polar ethylenically monomer has a weight average molecular weight in the range of about 2,800 to 7,000.

20. The thermographic element according to claim 12 wherein the fluorinated polymer is the acrylic reaction product of at least one fluorinated ethylenically unsaturated monomer and at least one polar ethylenically unsaturated monomer.

21. A process for formation of a visible image comprising heating the thermographic element of claim 12 to form an image.

* * * * *